US005957622A

United States Patent [19]

Vera-Montiel

[11] Patent Number: 5,957,622

[45] Date of Patent: Sep. 28, 1999

[54] SPRINKLER CONSTRUCTION FOR VIBRATORY PLATE COMPACTOR

[75] Inventor: Evaristo Vera-Montiel, Henrietta, N.Y.

[73] Assignee: Stone Construction Equipment, Honeoye, N.Y.

[21] Appl. No.: 09/015,977

[22] Filed: Jan. 30, 1998

[51] Int. Cl.[6] ..... E01C 19/35

[52] U.S. Cl. ..... 404/133.1; 239/159

[58] Field of Search ..... 404/133.1, 133.05, 404/133.2, 113; 239/146, 159

[56] References Cited

U.S. PATENT DOCUMENTS

| | | | |
|---|---|---|---|
| 1,097,090 | 5/1914 | Gray | 239/159 |
| 1,509,684 | 9/1924 | Monroe . | |
| 1,698,015 | 1/1929 | Fitzgerald | 239/146 |
| 2,909,970 | 10/1959 | Jackson | 94/49 |
| 3,064,904 | 11/1962 | Roberts | 239/146 |
| 3,416,417 | 12/1968 | McIlrath et al. | 94/48 |
| 3,675,546 | 7/1972 | Smith | 94/50 |
| 4,040,762 | 8/1977 | Nilsson | 404/129 |
| 4,113,403 | 9/1978 | Tertinek et al. | 404/113 |
| 4,421,435 | 12/1983 | Zemke et al. | 404/113 |
| 5,222,828 | 6/1993 | Magalski | 404/103 |
| 5,261,762 | 11/1993 | Yamaguchi | 404/133.05 |
| 5,439,314 | 8/1995 | Wadensten | 404/133.05 |
| 5,890,834 | 4/1999 | Waldenberger | 404/133.1 |

*Primary Examiner*—James A. Lisehora
*Attorney, Agent, or Firm*—Jacobson, Price, Holman & Stern, PLLC

[57] ABSTRACT

A sprinkler construction for mounting on any upwardly inclined forward end of the compactor plate of vibratory plate compactors for delivering water to the surface of the compactor plate which contacts material being compacted. The sprinkler construction comprises a hollow bar having an open rear side in contact with the plate which forms a closure for the open rear side and form a longitudinal chamber in the sprinkler bar. The bottom edge of the open rear side of the hollow sprinkler bar is provided with recesses which cooperate with the compactor plate to provide water discharge slots for discharging water along the surface of the compactor plate. The hollow sprinkler bar is removably mounted on the compactor plate to enable easy removal for cleaning the sprinkler bar from any debris that may accumulate therein. The hollow sprinkler bar is communicated with a water supply tank mounted above the compactor plate for gravity flow of water to the sprinkler bar controlled by a valve.

13 Claims, 2 Drawing Sheets

SPRINKLER CONSTRUCTION FOR VIBRATORY PLATE COMPACTOR

BACKGROUND OF THE INVENTION

1. Field of the Invention

This invention relates to a sprinkler construction for vibratory plate compactors for delivering water to the surface of the compactor plate which contacts material being compacted. The sprinkler construction is mounted on an upwardly inclined forward end of the compactor plate in the form of a hollow sprinkler bar or water delivery bar having an open rear side in contact with the plate which forms a closure for the open rear side of the hollow sprinkler bar. The bottom edge of the open side of the hollow sprinkler bar is provided with recesses which cooperate with the compactor plate to provide water discharge slots for discharging water along the surface of the compactor plate. The hollow sprinkler bar is removably mounted on the compactor plate to enable easy removal for cleaning any debris that may accumulate in the sprinkler bar. The hollow sprinkler bar is communicated with a water supply tank and valve mounted above the compactor plate for gravity flow of water to the sprinkler bar controlled by a valve.

2. Description of the Prior Art

Vibratory plate compactors are well known and have been commercially available for many years. Prior U.S. Pat. No. 4,113,403, issued Sep. 12, 1978, discloses one example of this type of compactor and includes a sprinkler construction illustrated best in FIG. 16 and designated by reference numerals 132–142.

In addition to the above patent, the following U.S. patents disclose relevant structures.

| | | |
|---|---|---|
| 1,509,684 | 3,675,546 | 4,421,435 |
| 2,909,970 | 4,040,762 | 5,222,828 |
| 3,416,417 | | |

The above patents disclose the concept of delivering water or other liquids to a surface of a compactor which comes into contact with the material being compacted. The application of water to the surface of the compactor is especially advantageous when compacting asphalt or similar material in order to prevent or materially reduce adhesion of the asphalt to the compacting surface. U.S. Pat. No. 4,113,403 utilizes a sprinkler tube having a series of holes drilled therein through which water is delivered to the compacting surface of the compactor plate. The tube is connected to a supply tank through a delivery hose and a shut off valve and the tube is mounted by a bracket mounted on the front end flange of the compactor plate. Water is supplied from the tube against the flange causing the water to wet the undersurface of the compacting plate. This structure includes requirements to drill holes in the tube, weld bolts and mount of a support bracket which require considerable time and labor in the initial construction and assembly, and subsequent disassembly for cleaning and reassembly.

SUMMARY OF THE INVENTION

The present invention constitutes an improved sprinkler construction for vibratory plate compactors and more specifically improvements over the structure disclosed in U.S. Pat. No. 4,113,403, the disclosure of which is specifically incorporated herein by reference the same as if the structure in that patent was fully set forth herein.

The sprinkler construction of the present invention is mounted on the compactor plate and includes a transversely extending single piece hollow sprinkler bar of molded plastic construction mounted on the compactor plate. Preferably, the hollow sprinkler bar is made of glass fiber reinforced plastic formed as a single piece injection molded part. The hollow bar is provided with an open rear side having a peripheral edge which engages with the compactor plate and forms a closure for the open side of the hollow bar when the hollow bar is mounted on the plate. When mounted on the flat surface of the plate, the hollow bar then forms an elongated water chamber for the sprinkler bar. The lower edge of the hollow bar is provided with longitudinal recesses which coact with the surface of the compactor plate to form discharge slots for delivering water from the chamber of the sprinkler bar onto the compacting surface of the compactor plate.

The hollow bar also includes tubular passageways for receiving mounting bolts with the tubular passageways being integral with the sprinkler bar and having inner ends engaging the compactor plate to isolate the tubular bolt passageways from water within the sprinkler bar. An upper surface of the sprinkler bar is provided with a hose fitting integral with the sprinkler bar for engagement with a delivery hose extending from a water supply tank oriented above the sprinkler bar and compactor plate for gravity flow of water to the chamber of the sprinkler bar through a manual control valve, a filter structure and hose. The lower peripheral edge of the hollow sprinkler bar is provided with a downwardly extending lip to reinforce the lower edge of the sprinkler bar having the recesses therein to provide rigidity to the lower edge of the open side of the hollow sprinkler bar.

Accordingly, an object of the present invention is to provide a sprinkler structure including a sprinkler bar having an open side sealingly engaged with the compacting plate of a vibratory plate compactor. The sprinkler bar is of one piece, molded construction which does not require drilling, welding and the like during manufacture and which can be quickly and easily mounted on the compactor plate.

Another object of the invention is to provide a sprinkler construction in accordance with the preceding object in which the molded sprinkler bar is provided with an open side having a peripheral edge in sealing engagement with the surface of the compactor plate which enables the interior surface of the sprinkler bar to be easily cleaned by rinsing off debris when the sprinkler bar is simply removed from the compactor plate by removing a pair of mounting bolts which secure the sprinkler bar to the compactor plate.

A further object of the invention is to provide a molded sprinkler bar in accordance with the preceding objects in which the lower edge of the sprinkler bar defining the open side thereof includes spaced, longitudinally extending recesses which cooperate with the surface of the compactor plate to provide discharge slots for delivering water at multiple points along the surface of the compactor plate. The discharge slots are continuous from end to end.

Still another object of the invention is to provide a hollow sprinkler bar of one-piece molded plastic construction fastened to the front surface of the compactor plate with two bolts thereby not only simplifying the manufacture of the sprinkler structure, but also simplifying the assembly of the sprinkler bar to the compactor plate. The construction also simplifies removal for cleaning the interior of the sprinkler bar when necessary and reassemble the bar to the plate in order to efficiently discharge water along multiple surface areas of the compactor plate.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
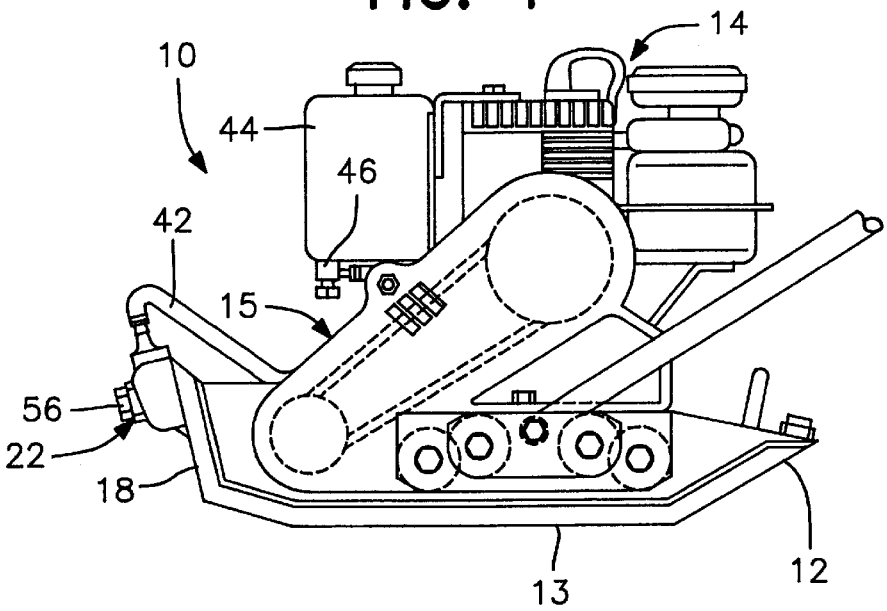
FIG. 1 is a side elevational view of a vibratory compacting machine incorporating the sprinkler construction of the present invention therein illustrating the sprinkler bar mounted on the forward end of the compactor plate.

Although only one preferred embodiment of the invention is explained in detail, it is to be understood that the invention is not limited in its scope to the details of construction and the arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Figure 8:
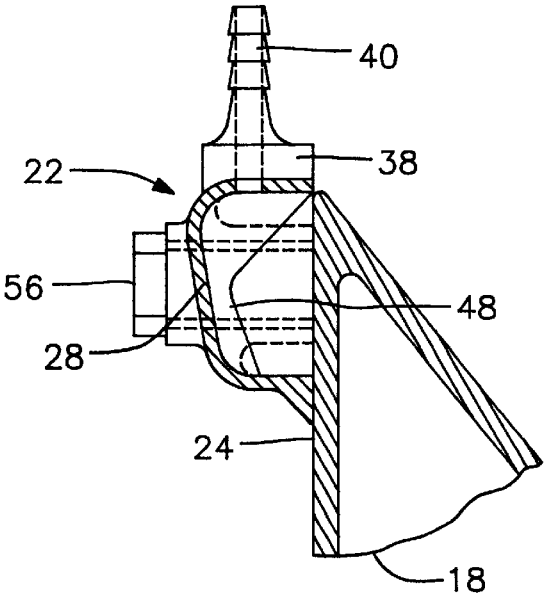
FIG. 8 is a fragmental sectional view illustrating the sprinkler bar of the present invention mounted on an incline flange at the forward end of the compactor plate.

As illustrated in FIG. 1, a vibratory plate compactor is illustrated and designated by reference numeral 10 which includes a base 12 which forms a compacting plate which has a lower surface 13 which engages the material to be compacted in a well known manner. The compactor includes an internal combustion engine 14 drivingly connected to a vibratory generator or assembly through a drive belt assembly 16. The forward end of the compacting plate 12 is upwardly inclined at 18. The above construction is basically the same as that disclosed in U.S. Pat. No. 4,113,403. The sprinkler construction of the present invention is generally designated by reference numeral 22 and is mounted on the forward end 18 of plate 12 as illustrated in FIGS. 1 and 8 so that water 24 is discharged onto the surface of the forward end 18 as well as the lower surface 13 of the compacting plate 12.

The sprinkler construction 22 includes a hollow sprinkler bar or water delivery bar 26 of one-piece construction. Preferably, bar 26 is an injection molded glass fiber reinforced plastic of known material for applications subject to constant vibrations. The bar 26 includes an outer front wall 28, a top wall 30, a bottom wall 32 and end walls 34. The rear side of the sprinkler bar 22 opposite the front wall 28 is open at 35 which is defined by a peripheral edge 36 that sealingly engages the forward surface of inclined end portion 18 of the compactor plate as illustrated in FIG. 8. The plate portion 18 is substantially flat so as to properly seal along peripheral edge 36. When so engaged the sprinkler bar 22 and plate 18 form an elongated chamber generally designated by the numeral 37.

The top wall 30 of the sprinkler bar 22 is provided with a hose fitting 38 including a tubular projection 40 extending upwardly therefrom to which is sealingly connected a flexible hose 42 connected to a water supply tank 44 through a shut off valve 46. The water supply tank hose 42, and valve 46 provide controlled gravity flow of water from the tank 44 to the sprinkler bar 26 and into chamber 37.

The interior of the sprinkler bar 26 includes a pair of spaced vertically extending reinforcing walls 48 extending between the top wall 30 and bottom wall 32. Also, a pair of parallel sleeves 50 extend through the front wall 28 to the open rear side 35. When installed the inner ends of sleeves 50 engage the inclined end portion 18 to strengthen and stabilize the sprinkler bar 26 on the compactor plate. The outer end of the sleeves 50 project slightly outwardly beyond the front wall 28 as indicated at 52 and the interior of the sleeves 50 are preferably reinforced by metal sleeves 54. The sleeves 50, 54 receive mounting bolts 56 screw threaded into the end 18 of plate 12, as illustrated in FIG. 8, in order to quickly and easily mount the sprinkler bar 26 on the end portion 18. This construction also enables easy removal of the sprinkler bar 26 to enable the hollow interior of the sprinkler bar to be easily cleaned, such as by rinsing debris or the like therefrom.

Figure 2:
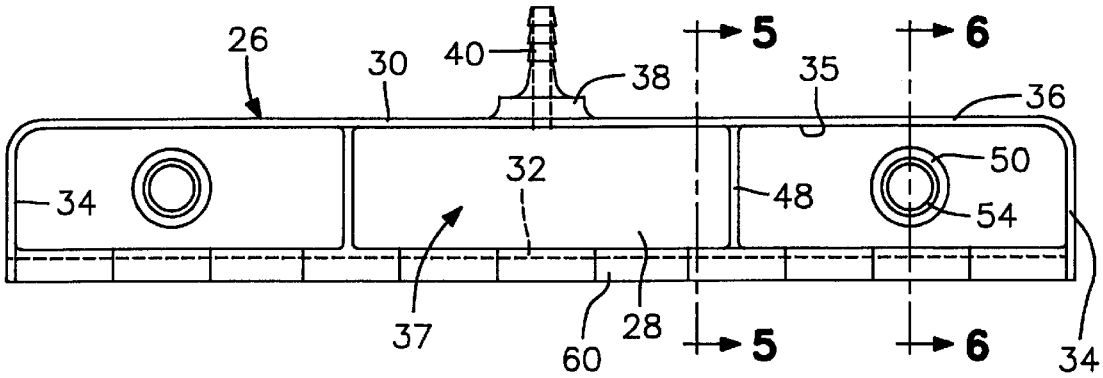
FIG. 2 is an elevational view of the sprinkler bar of the present invention from the open rear side thereof.
Figure 3:
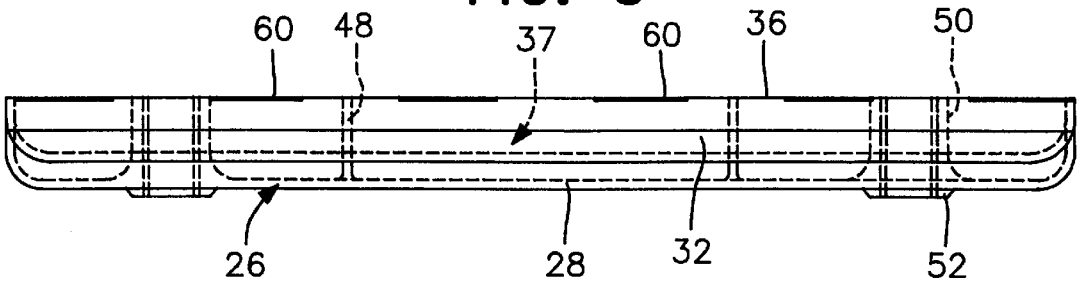
FIG. 3 is a bottom plan view of the sprinkler bar of FIG. 2.
Figure 4:
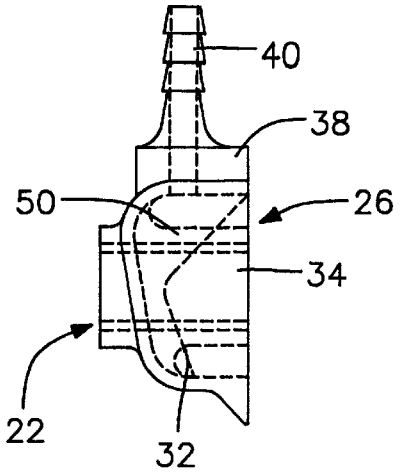
FIG. 4 is an end elevational view of the sprinkler bar of FIG. 2.
Figure 5:
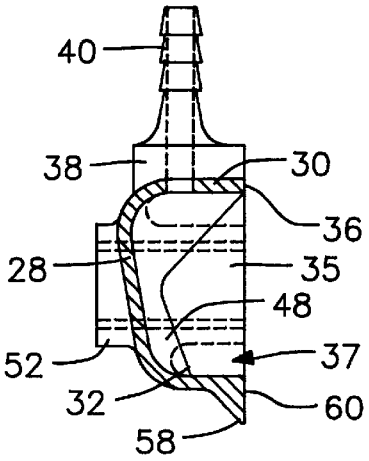
FIG. 5 is a vertical sectional view of the sprinkler bar taken along section line 5—5 on FIG. 2.
Figure 6:
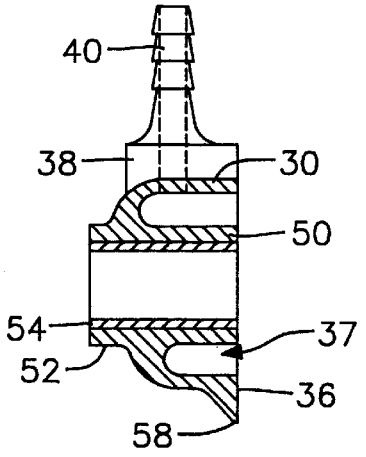
FIG. 6 is a vertical sectional view of the sprinkler bar taken along section line 6—6 on FIG. 2.
Figure 7:
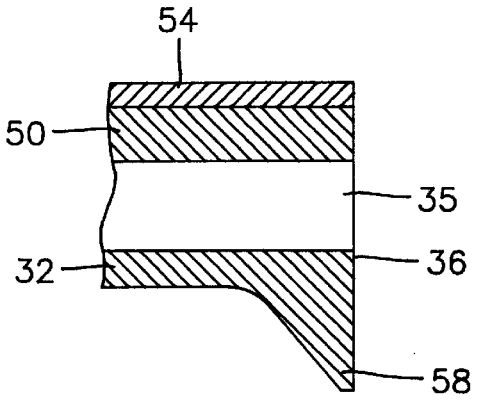
FIG. 7 is an enlarged fragmental view of a lower inner peripheral edge portion of the sprinkler bar of FIG. 2.

The bottom wall 32 of the sprinkler bar 26 is provided with a depending lip 58 along the peripheral edge 36, as illustrated in FIG. 7, to reinforce the bottom wall 32 and rigidify the structure of the inner peripheral edge of the bottom wall 32. The inner peripheral edge of the bottom wall 32 includes a plurality of longitudinally extending shallow recesses 60, illustrated in FIGS. 2, 3 and 5, which define a plurality of water discharge slots oriented in spaced relation along the length of the peripheral edge 36 of the bottom wall 32. The shallow recesses 60 are preferably about 0.030" in depth and cooperate with the surface of the inclined end portion 18 to provide a plurality of water discharge slots. Each of the slots is continuous for the length of the recess for discharging the water 24 in a thin continuous column from the bottom edge of the sprinkler bar 26 with the thin columns merging as the water 24 progresses down the surface of the inclined front 18 of the compactor plate 12.

The sprinkler system 22 including the tank, shut off valve, delivery hose and the one piece injection molded sprinkler bar can be easily assembled onto the compactor with the open rear side 35 of the sprinkler bar 26 sealingly engaging the surface of the inclined front end portion 18. When installed, the recesses 60 provide a plurality of slots for discharge of water from chamber 37 along the surface of the upwardly inclined forward edge 18 of the compactor plate 12. The bolts 56 are utilized to quickly and easily mount the sprinkler bar in position and also enable the sprinkler bar to be quickly removed, cleaned of debris and replaced when this becomes necessary. The thin columns of water discharged through the slots defined by the recesses 60 and the surface of the inclined front end 18 of the compactor plate 12 distributes the water widely along the surface of the compactor plate as it moves forwardly in order to effectively avoid or reduce adhesion of asphalt or other material to be compacted to the bottom surface of the compactor plate 12.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In a vibratory plate compactor having a plate for contacting material to be compacted with the plate including an upwardly inclined forward end, a water delivery bar adapted to be mounted on the inclined forward end of the compactor plate, said water delivery bar extending transversely of the compactor plate and including an open side having an upper and side edges in sealing contact with the inclined forward end of the compactor plate, a water supply system communicating with an interior of the water delivery bar, a lower edge portion of the open side of the water delivery bar including a plurality of thin recesses extending across the lower edge portion and cooperating with the inclined forward end of the compactor plate to form discharge slots to enable water to flow by gravity along the surface of the compactor plate and fasteners releasably securing the water delivery bar to the surface of the forward end of the compactor plate.

2. The water delivery bar as defined in claim 1 wherein said bar includes a pair of sleeves extending from an outer surface of the bar to the open side of the bar for engagement with the inclined forward end of the compactor plate, said fasteners securing the bar to the inclined forward end of the plate including a bolt extending through each of the sleeves.

3. The water delivery bar as defined in claim 2 wherein said delivery bar includes a lower wall having a thickened lip along the lower edge portion of the open side of the bar for reinforcing a bottom wall of the bar with the recesses extending continuously from the top to bottom of the bottom wall and lip.

4. The water delivery bar as defined in claim 1 wherein said water delivery bar includes a top wall having a hose fitting incorporated therein and extending upwardly for connection with a hose to supply water to the bar.

5. The water delivery bar as defined in claim 1 wherein said water delivery bar is constructed of a single piece of injection molded glass fiber reinforced plastic.

6. The water delivery bar as defined in claim 1 wherein each of said recesses has a thickness of approximately 0.030 inches.

7. In a vibratory compactor having a rigid vibratory compacting surface for contacting material to be compacted, said rigid vibratory compacting surface including a generally horizontal portion and an upwardly extending edge portion, a water delivery bar adapted to be mounted on the upwardly extending edge portion of the rigid vibratory compacting surface, said water delivery bar extending along the upwardly extending edge portion of the rigid vibratory compacting surface and including an open side having a top edge and side edges in sealing contact with the upwardly extending edge portion of the rigid vibratory compacting surface, a water supply system communicating with an interior of the water delivery bar, a lower edge portion of the open side of the water delivery bar including a plurality of longitudinally extending thin recesses cooperating with the upwardly extending edge portion of the rigid vibratory compacting surface to form discharge slots to enable water to flow by gravity downwardly along the surface of the upwardly extending edge portion of the rigid vibratory compacting surface onto the horizontal portion thereof and fasteners releasably securing the water delivery bar to the upwardly extending edge portion of the rigid vibratory compacting surface.

8. The water delivery bar as defined in claim 7 wherein said delivery bar includes a lower wall having a thickened lip along the lower edge portion of the open side of the bar for reinforcing a bottom wall of the bar with the recesses extending continuously from the top to bottom of the lower wall and lip.

9. A one-piece housing adapted to be mounted on an upwardly inclined front surface of a vibratory compacting plate for contacting material to be compacted, said housing extending transversely of the front surface of the plate and including an elongated chamber having an open side to form a water delivery bar when said housing is installed on the front surface of the compactor plate, said open side of the housing including an upper edge and side edges in sealing contact with the inclined front surface of the compactor plate, a water supply system communicating with said elongated chamber, said open side of said housing including a lower edge having a plurality of shallow recesses extending across said lower edge and cooperating with the inclined forward surface of the compactor plate to form discharge slots to enable water to flow by gravity along the surface of the compactor plate.

10. The housing as defined in claim 9 wherein said housing includes a lower wall having a thickened lip along the lower edge thereof reinforcing a bottom wall of the housing with the recesses extending continuously from the top to bottom of the bottom wall and lip.

11. The housing as defined in claim 9 wherein said water supply system includes a hose fitting incorporated in the housing for connection with a hose to supply water to the elongated chamber.

12. The housing as defined in claim 9 wherein a pair of sleeves extend from an outer surface of the housing to the open side thereof for engagement with the inclined front surface of the compactor plate, said fasteners adapted to secure the housing to the inclined front surface of the plate and including a bolt extending through each of the sleeves.

13. The housing as defined in claim 9 wherein said housing is hollow and constructed of a single piece of molded plastic.

* * * * *